US010737830B1

(12) United States Patent
Arriaga

(10) Patent No.: US 10,737,830 B1
(45) Date of Patent: Aug. 11, 2020

(54) WASHABLE TRASH CONTAINER WITH INTERLOCKING PANELS

(71) Applicant: Anthony Raul Arriaga, Costa Mesa, CA (US)

(72) Inventor: Anthony Raul Arriaga, Costa Mesa, CA (US)

( * ) Notice: Subject to any disclaimer, the term of this patent is extended or adjusted under 35 U.S.C. 154(b) by 80 days.

(21) Appl. No.: 15/885,733

(22) Filed: Jan. 31, 2018

Related U.S. Application Data

(60) Provisional application No. 62/453,500, filed on Feb. 1, 2017.

(51) Int. Cl.

| | |
|---|---|
| ***B65D 6/16*** | (2006.01) |
| ***B65D 6/24*** | (2006.01) |
| ***B65F 1/14*** | (2006.01) |
| ***B65F 1/16*** | (2006.01) |
| ***B65F 1/02*** | (2006.01) |
| ***B65D 6/26*** | (2006.01) |

(52) U.S. Cl.
CPC ..... *B65D 11/1873* (2013.01); *B65D 7/24* (2013.01); *B65D 7/30* (2013.01); *B65F 1/02* (2013.01); *B65F 1/16* (2013.01); *B65F 2220/101* (2013.01); *B65F 2220/106* (2013.01)

(58) Field of Classification Search
CPC ..... B65D 7/24; B65D 7/28; B65D 2525/285; B65D 11/1873; B65F 2220/101; B65F 2220/106
See application file for complete search history.

(56) References Cited

U.S. PATENT DOCUMENTS

| | | | |
|---|---|---|---|
| 949,204 | A | 2/1910 | Stiehl |
| 1,177,513 | A | 3/1916 | Gustafson |
| 1,316,061 | A | 9/1919 | Rotenberger |
| 1,470,207 | A | 10/1923 | Walker |
| 1,656,497 | A | 1/1928 | Paulson et al. |

(Continued)

FOREIGN PATENT DOCUMENTS

| | | | |
|---|---|---|---|
| CN | 203064565 | U | 7/2013 |
| JP | 2003292087 | A * | 10/2003 |

(Continued)

*Primary Examiner* — Daniel J Colilla

(57) ABSTRACT

The present invention is a waste container that includes: a substantially quadrilateral base member having a perimeter edge; a front panel extending substantially vertically from the base; a rear panel extending substantially vertically from the base, wherein the front and rear panel are disposed opposite one another; a first side panel extending substantially vertically from the base; a second side panel extending substantially vertically from the base. The first side and second side panels are disposed opposite one another; and the front, rear, first side and second side panels which abut one another are detachably interconnected. The waste container further includes: a panel attachment member along the perimeter edge of the base; a base attachment member along the edge of the front, rear, first side and second side panel that contact the base member, where the panel and base attachment members are adapted to interconnect; and where the container is adapted to separate into a detached base and side panels. The container permits the user the ability to assemble and disassemble the container for easy cleaning and portability.

14 Claims, 22 Drawing Sheets

(56) References Cited

U.S. PATENT DOCUMENTS

| | | | | | |
|---|---|---|---|---|---|
| 2,185,770 | A | | 1/1940 | Larson | |
| 3,026,008 | A | * | 3/1962 | Bertram | B65D 5/004 16/422 |
| 3,182,847 | A | | 5/1965 | Fuller | |
| 3,288,325 | A | | 11/1966 | Fulton | |
| 3,540,613 | A | * | 11/1970 | Hudson, Jr. | B65D 7/24 217/12 R |
| 4,651,791 | A | | 3/1987 | Evenson | |
| 4,809,851 | A | | 3/1989 | Oestreich, Jr. et al. | |
| 5,096,080 | A | | 3/1992 | Penny | |
| 5,419,453 | A | | 5/1995 | Lochridge | |
| 5,560,508 | A | | 10/1996 | Hsu | |
| 5,678,717 | A | | 10/1997 | Hsu | |
| 5,887,741 | A | | 3/1999 | Chiang | |
| 6,401,952 | B1 | | 7/2002 | Ming | |
| 6,508,377 | B1 | | 1/2003 | Griswold | |
| 8,210,379 | B2 | | 7/2012 | Afflerbach et al. | |
| 8,261,922 | B2 | | 9/2012 | Jin et al. | |
| 8,689,992 | B2 | | 4/2014 | Anderson et al. | |
| 2004/0256385 | A1 | * | 12/2004 | Hartwall | B65D 19/18 220/6 |
| 2007/0125778 | A1 | | 6/2007 | Uffner | |
| 2007/0194020 | A1 | | 8/2007 | Hotze | |
| 2013/0284306 | A1 | * | 10/2013 | Carlson | B65D 25/32 141/1 |

FOREIGN PATENT DOCUMENTS

| | | | | |
|---|---|---|---|---|
| JP | 2014144818 | A | * | 8/2014 |
| JP | 2018140815 | A | * | 9/2018 |

* cited by examiner

WASHABLE TRASH CONTAINER WITH INTERLOCKING PANELS

CROSS-REFERENCE TO RELATED APPLICATIONS

The current application claims priority to U.S. Provisional Patent Application Ser. No. 62/453,500 filed Feb. 1, 2017, which is incorporated by reference in its entirety.

BACKGROUND OF THE INVENTION

Currently there are a number of solutions for waste containers. Some of these solutions attempt to simply provide a unit for disposing of waste with varying scopes of quality but these solutions fail to meet the needs of industry or consumers because they fail to allow the user to easily clean and transport the unit. Other solutions attempt to provide a unit for disposing of waste with varying scopes of size but these solutions are similarly unable to meet the needs of the industry because they do not provide the user with an appropriate size that can be easily cleaned and transported efficiently. It would be desirable to have a waste container that can be easily cleaned and is portable. Therefore, there currently exists a need for an improved waste container.

SUMMARY OF THE INVENTION

One object of the invention is to overcome at least one of the deficiencies of the prior art noted above. Another object of the invention is to provide a waste container that can be easily cleaned and transported efficiently. It is still further an object of the present invention to create a device that permits the user the ability to assemble and disassemble the container for easy cleaning and portability. Yet another object of the present invention is to provide a waste container with interlocking panels and connecting pieces that does not suffer from any of the problems or deficiencies associated with prior solutions.

According to one aspect of the invention there has been provided a waste container, which is made up of the following components: a four-sided bottom piece with edges that are curved upward, four panel pieces that interlock to each other and connect to the curved edges of the four-sided bottom piece. An optional four-sided piece with curved sides and a lid, optionally on hinges, can be placed on the top of the present invention to provide for an opening and closing lid.

According to another aspect of the invention there has been provided a waste container that includes: a substantially quadrilateral base member having a perimeter edge; a front panel extending substantially vertically from the base; a rear panel extending substantially vertically from the base, wherein the front and rear panel are disposed opposite one another; a first side panel extending substantially vertically from the base; a second side panel extending substantially vertically from the base. The first side and second side panels are disposed opposite one another; and the front, rear, first side and second side panels which abut one another are detachably interconnected. The waste container further includes: a panel attachment member along the perimeter edge of the base; a base attachment member along the edge of the front, rear, first side and second side panel that contact the base member, where the panel and base attachment members are adapted to interconnect; and where the container is adapted to separate into a detached base and side panels.

In a preferred embodiment, the base member includes walls vertically extending upward to form a water-tight base. In another preferred embodiment, the detached base and panels are dimensioned to fit into a dishwasher or a sink.

In another preferred embodiment, the waste container includes a removable handle, and the handle is adapted to connect to opposing vertically extending walls when the container is in an unassembled state, more preferably the handle includes protrusions on the ends of the handle and corresponding recesses on the opposing walls of the base member to receive the protrusions.

Another aspect of the invention provides a waste container kit that includes: (a) the waste container described above in a disassembled state; and (b) instructions for loading disassembled pieces into an automatic dishwasher, and (c) optionally instructions for assembling the waste container.

Still another aspect of the invention provides a waste container kit that includes: (a) the waste container described above in a disassembled state; (b) instructions for assembly; (c) instructions for loading disassembled pieces into an automatic dishwasher; and (d) instructions for attaching the handle to the base member.

Yet another aspect of the invention provides a method of cleaning a waste container that includes: (a) providing the waste container as described above; (b) disassembling the waste container; (c) placing the disassembled waste container into an automatic dishwasher or sink; (d) washing the container; and (e) removing the container.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
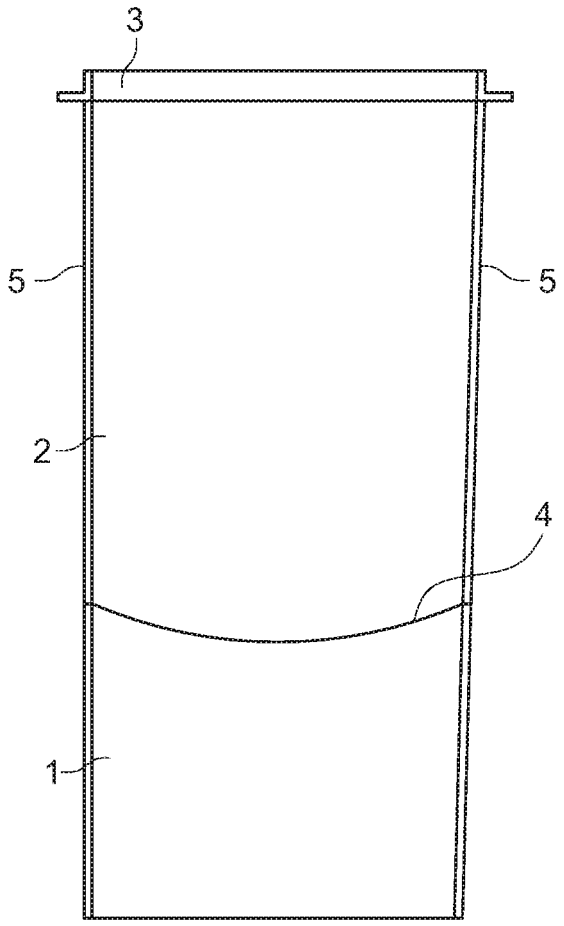
FIG. 1 depicts a preferred embodiment of the present invention when viewed from either the front or rear.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION OF PREFERRED EMBODIMENTS

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It is further understood that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

One aspect of the present invention provides a waste container that can be disassembled for subsequent cleaning, such as in a commercial or household dishwasher or sink. This is accomplished in part by providing a waste container with interlocking panels and a base member that are dimensioned to fit in a dishwasher or sink. The household dishwasher is about 24 inches wide, 24 inches deep and 35 inches high. The household sink preferably has the dimensions of 30-by-40 inches, preferably 22-by-30 inches.

The present invention has options for design, style and length for both itself and the panels and pieces that comprise the waste container. It also has options for waterproofing the device by using a rubber or other type of seal on each panel and piece.

The present invention is superior to other known solutions and inventions because it: (1) permits the user to disassemble the unit for easy cleaning in a household sink or household appliance such as a dishwasher which can then be reassembled to be used as a waste container; (2) provides for varying options that takes into consideration user preferences as to varying size, design and quality; and (3) is able to be disassembled so that it can be efficiently transported.

A first preferred embodiment of the present invention includes a four-sided bottom piece with edges that are curved upward which attach to four interlocking panels of the present invention. Each panel creates one side of the four-sided waste container. The present invention also provides for an optional four-sided piece with curved sides and a panel on hinges which can be placed on top of the present invention to provide for an opening and closing lid.

FIG. 1 depicts of an embodiment of the present invention when viewed from either the front or rear when assembled showing the four-sided bottom piece 1 (i.e., base member), panel 2, hinged lid 3, the general location of a type of panel and base attachment members used to connect the four-sided bottom piece to the panels 4 and the general location of a type of mechanism, such as mated attachment members, used to connect the panels to each other 5.

Figure 2:
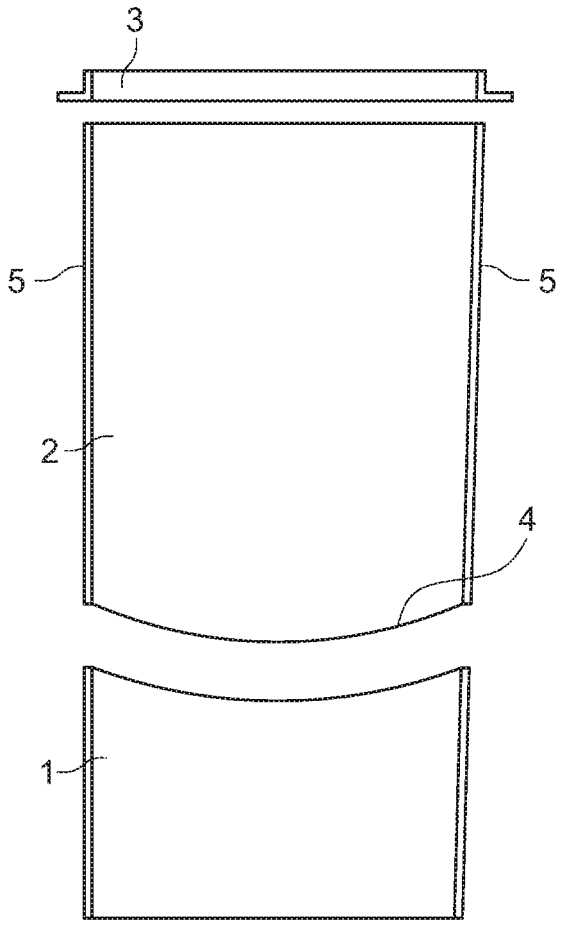
FIG. 2 depicts a preferred embodiment of the present invention when viewed from either the front or rear when disassembled.

FIG. 2 depicts an embodiment of the present invention when viewed from either the front or rear when disassembled showing the four-sided bottom piece 1, panel 2, hinged lid 3, the general location of a panel and base attachment members used to connect the four-sided bottom piece to the panels 4 and the general location of mated attachment members used to connect the panels to each other 5.

Figure 3:
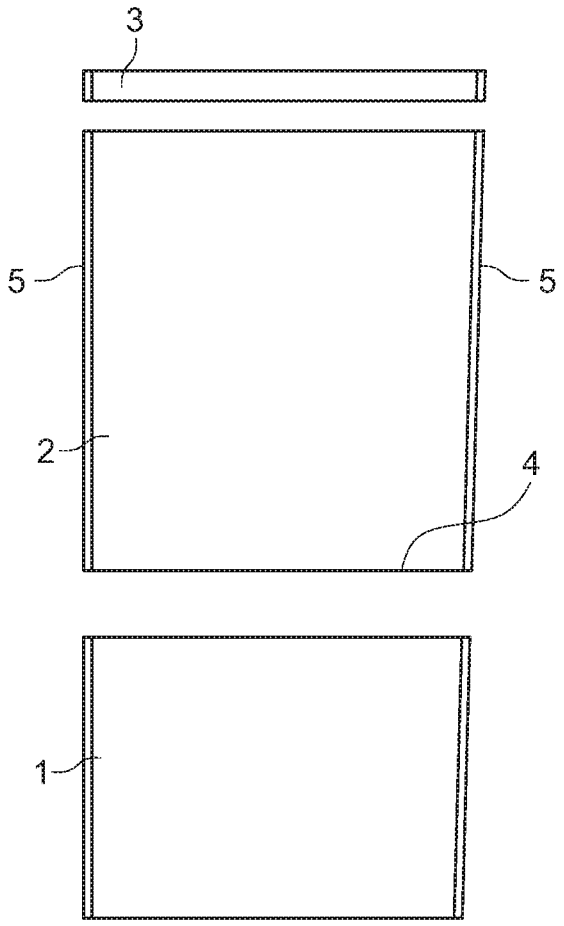
FIG. 3 depicts a preferred embodiment of the present invention when viewed from either the left or right side when disassembled.
Figure 4:
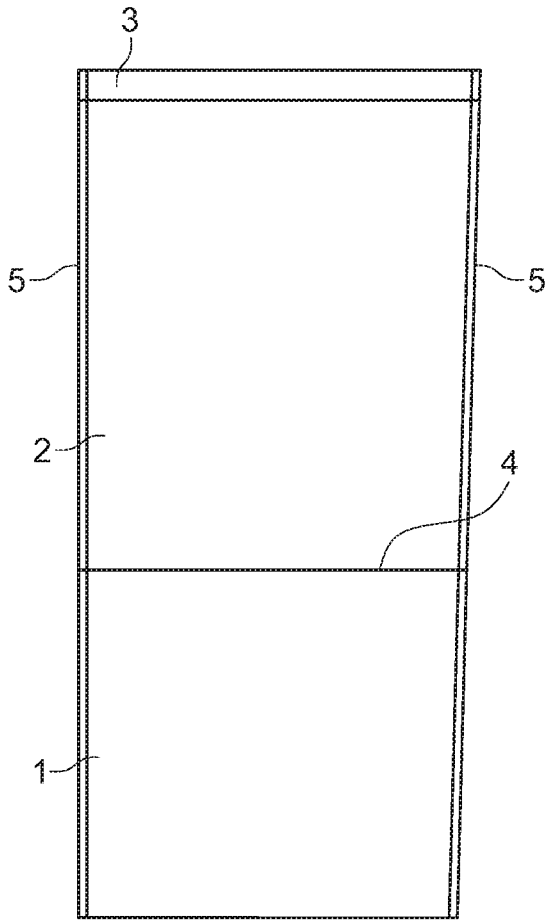
FIG. 4 depicts a preferred embodiment of the present invention when viewed from either the left or right side when assembled.

FIGS. 3 and 4 depict an embodiment of the present invention when viewed from either the left or right side when disassembled showing the four-sided bottom piece 1, panel 2, hinged lid 3.

Figure 5:
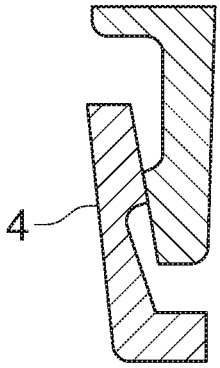
FIG. 5 depicts a preferred embodiment of a type of mechanism used to connect the four-sided bottom piece to the panels.

FIG. 5 is a diagram of an embodiment of a type of panel and base member attachment members used to connect the four-sided bottom piece to the panels 4, such as a tab and mated slot.

Figure 6:
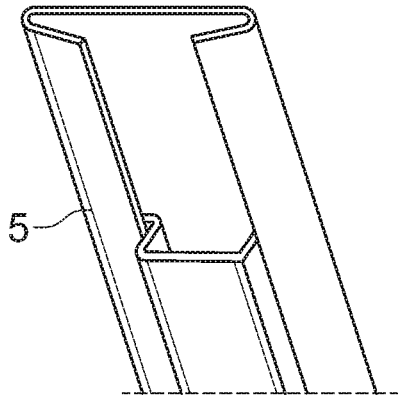
FIG. 6 depicts a preferred embodiment of a type of interlocking mechanism used to connect the panels to each other.

FIG. 6 is a diagram of an embodiment of a type of mated attachment members used to connect the panels to each other 5. The mated attachment members include a female attachment member which is a channel having a cross-sectional C-shape with inwardly extending flanges. The other part of the mated attachment member is a channel having a cross-sectional C-shape with outwardly extending flanges. The outwardly extending flanges are configured to slidably engage into the inwardly extending flanges of channel having the cross-sectional C-shape. Preferably, the outwardly extending flanges are in contact with and lie within the inner flanges.

Figure 7A:
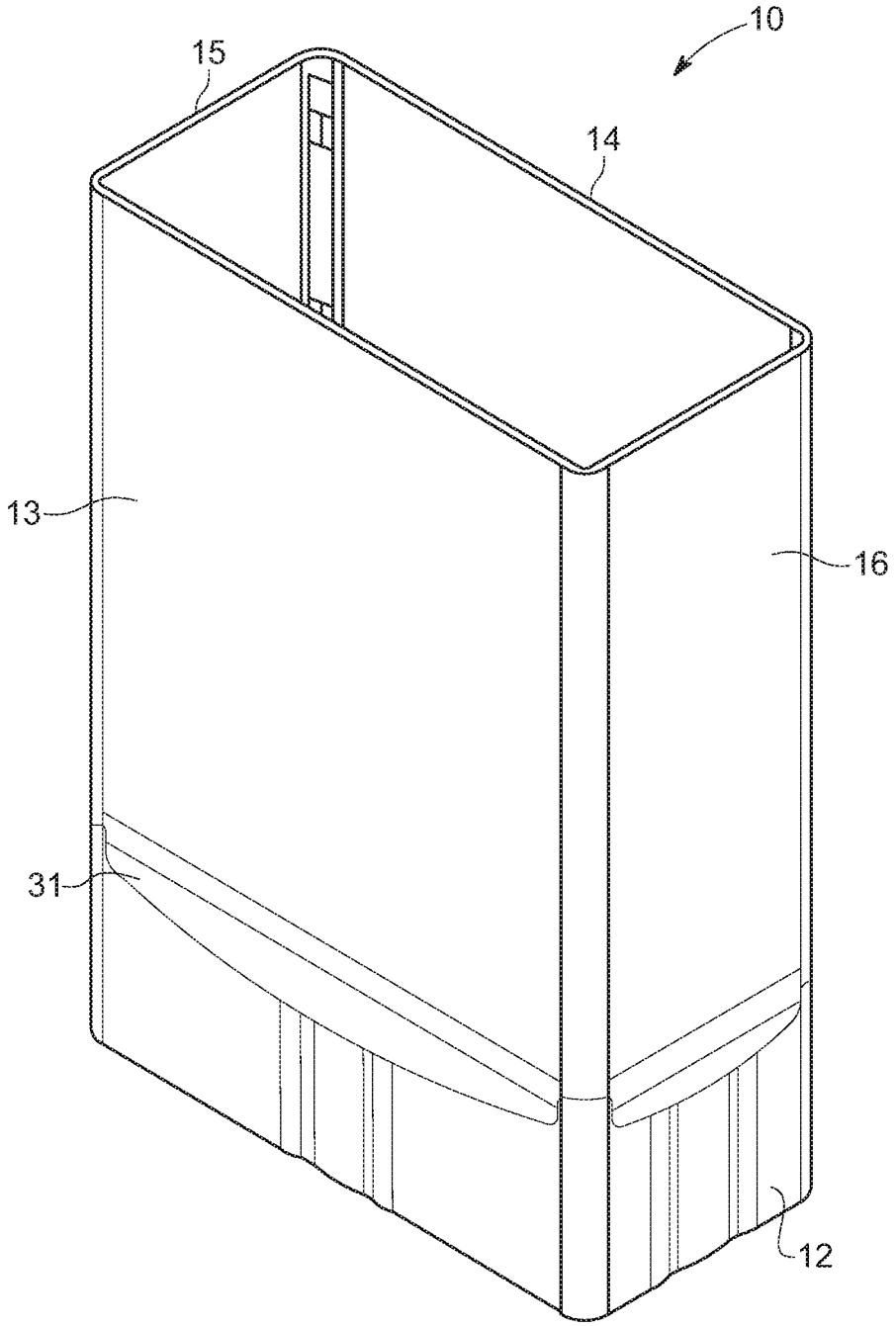
FIG. 7A depicts a three-dimensional view of an assembled waste container according to another preferred embodiment.

According to another preferred embodiment, such as that shown in FIG. 7A waste container 10 includes a base member or four-sided bottom 12, a front panel 13, a rear panel 14, first side panel 15 and second side panel 16, collectively called "panels."

Figure 17A:
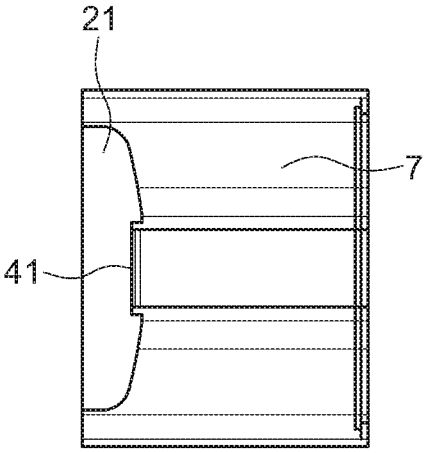
FIG. 17A shows a planar side view of the side of the base portion according to a preferred embodiment.
Figure 17B:
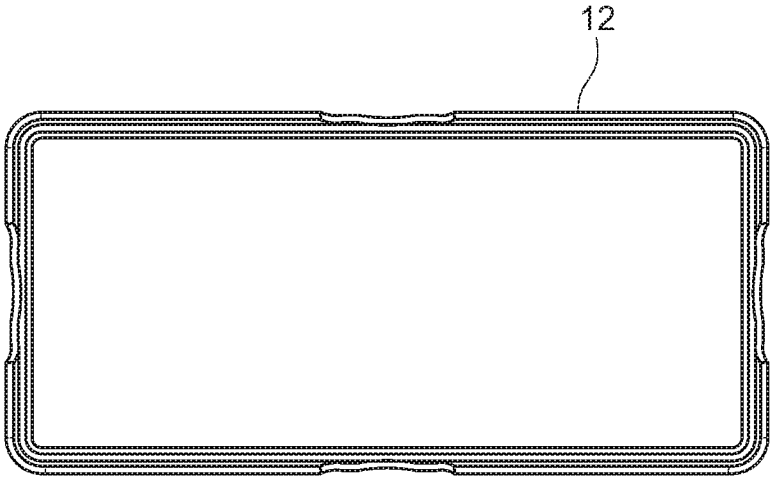
FIG. 17B shows a planar top view of the side of the base portion looking inside according to a preferred embodiment.
Figure 17C:
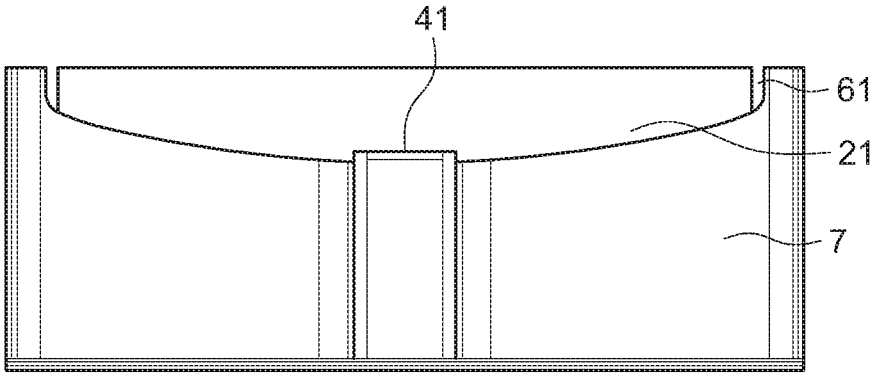
FIG. 17C shows a planar side view of the side of the base portion according to a preferred embodiment.

The base member 12 is preferably a one-piece, fluid- or water-proof structure having a substantially quadrilateral preferably rectangular cross-section having a perimeter edge and a panel attachment member along the base of the perimeter edge. In one embodiment, the perimeter edge has substantially vertically extending side walls 7 as seen in FIG. 17 which contribute to its water-tight configuration. Vertically extending side walls 7 of the base member extend upward from the floor of the base member 12 significantly to catch any liquid spills and keep them contained.

Figure 13:
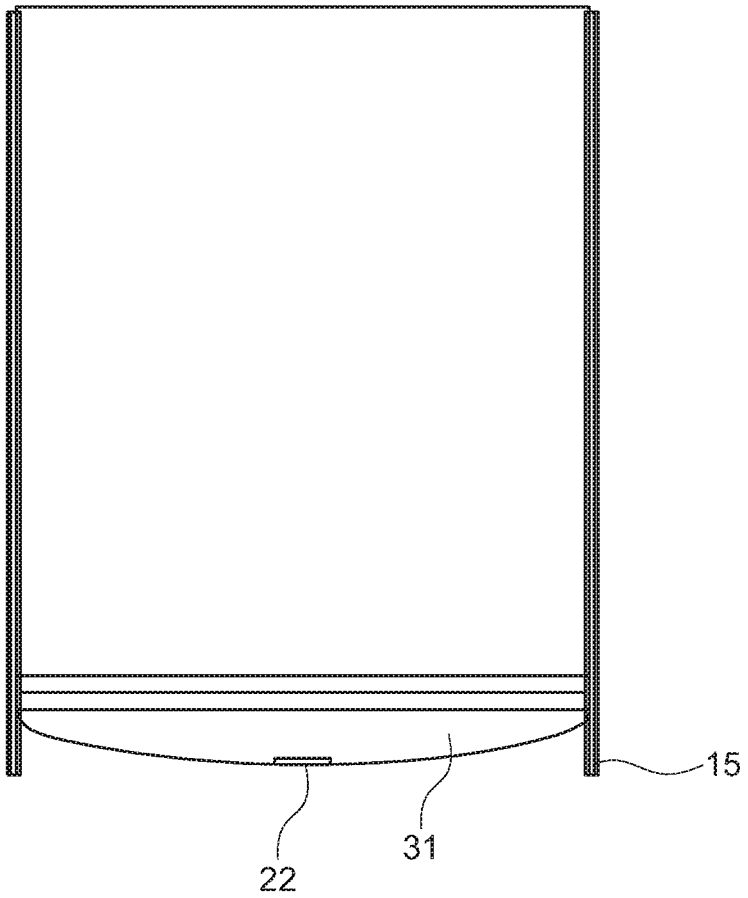
FIG. 13 shows a disassembled planar view of the front or rear panel.
Figure 15:
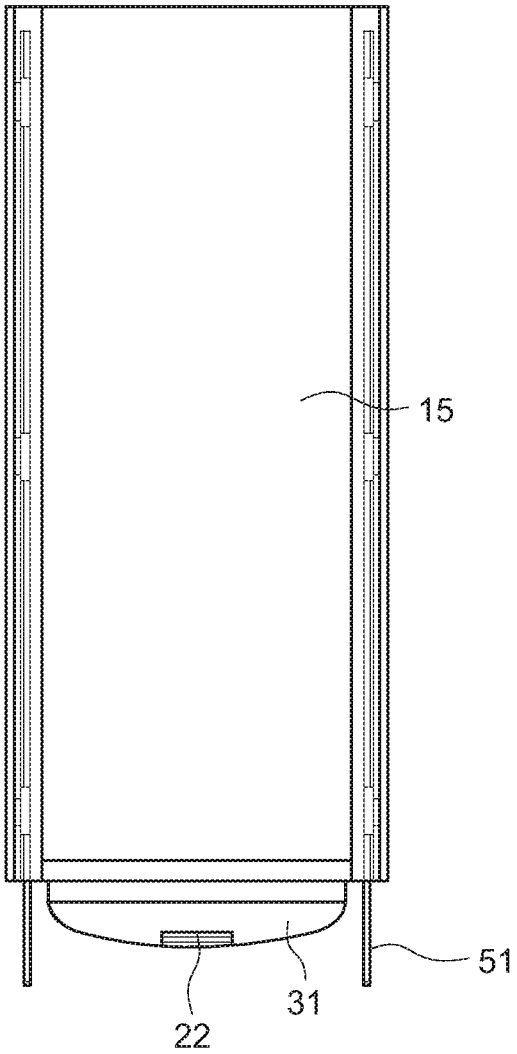
FIG. 15 shows a planar view of the inside of the side panel according to a preferred embodiment.

In one embodiment, the panel attachment member includes vertically extending side walls 31 having support bars 15 to engage slots 16 of the wall of the base member as seen in FIG. 13. The vertically extending side walls panels support bars 51 engage the base member as seen in FIG. 15. The base and panels can be made of any suitable material, such as plastic or metal. In a preferred embodiment, the base and panels are made from an injection molded polymer, such as high-density polyethylene, polypropylene, polystyrene, polyvinylchloride. Other fabrication methods can include, e.g., 3-D printing. Further details of preferred panel attachment members are provided below.

As described above, the container also includes a front panel 13 and a rear panel 14 and two side panels 15 and 16. In a preferred embodiment, the panels are identical, with the possible exception of dimensions and support bars 51 and description is generally made with regards to either panels collectively or front panel 13 only. The panels are generally planar and include base attachment members to attach to panel attachment member described in part above and more fully below. In one embodiment, the base attachment members on the panels includes support bars 15 as shown in FIG. 13 which extend from the bottom of each panel, a retaining tab 22, which extends toward the interior of the waste container, on flap, also called over lip 31, as seen in FIG. 13. The over lip 31 extends from the bottom of the panels and is configured to lie flush with base member undercut described below.

Figure 7B:
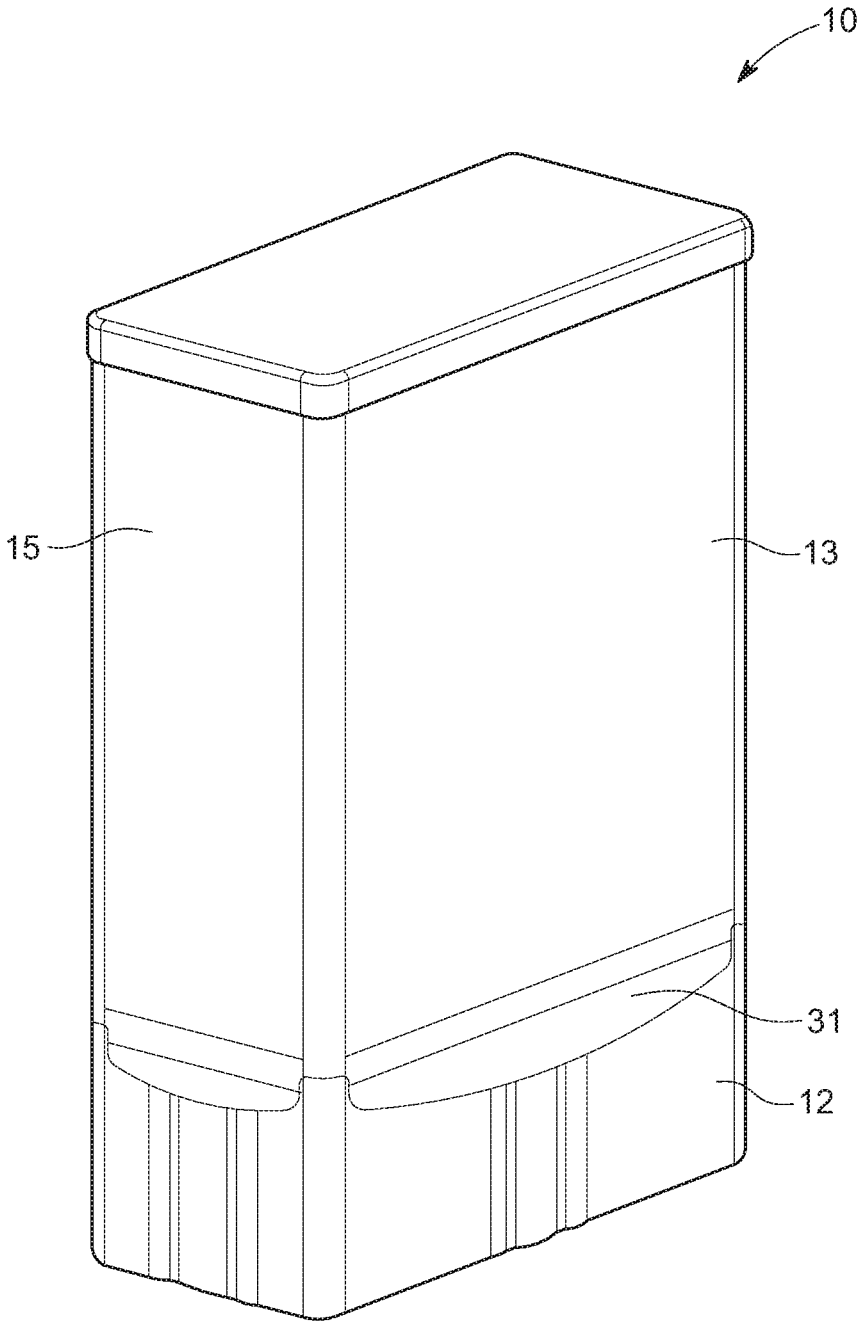
FIG. 7B depicts a three-dimensional view of an assembled waste container according to another preferred embodiment with a lid.
Figure 14:
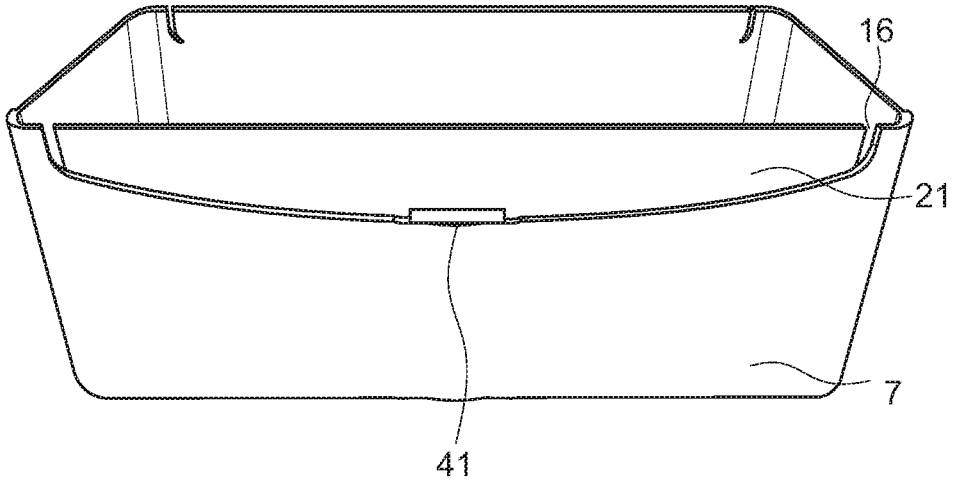
FIG. 14 shows a three-dimensional view of the base portion according to a preferred embodiment.
Figure 16:
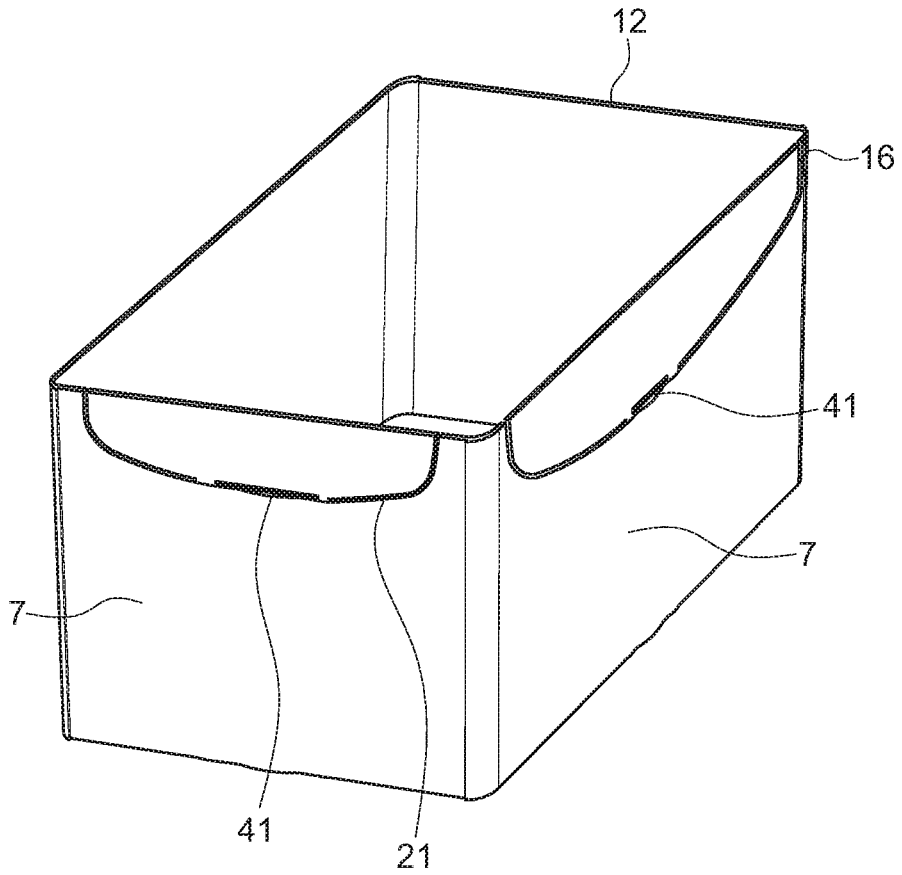
FIG. 16 shows another three-dimensional view of the base portion according to a preferred embodiment.

The base member 12 includes an undercut 21 and additional recess, also called slot 41, as seen in FIG. 16. Slot 41 locks into retaining tab 22 as seen in FIGS. 13 and 15, which protrudes from the bottom of over lip 31. The retaining tab 22 as seen in FIGS. 13 and 15 is located on the bottom of each panel under the over lip 31 as seen in FIG. 15. The dimensions of the over lip 31 and undercut 21 in walls 7 of the base member are dimensioned such that when assembled retaining tab 22 inserts into slot 41 and over lip 31 and undercut 21 form a flush fit, whereby each panel rests securely on the base wall 7 as seen in FIGS. 7A and 7B. Panel support bars 51 extending from the panels as seen in FIG. 15 make the container more tightly fit together when attached to the base wall 7. Thus, when lowered, the support bar 51 fit engages the bases front and rear clearance slots 16 as seen in FIG. 14, the over lip 31 of the panels resting on the base wall 7 along with the undercut 21 of the base and slot 41 interlocking the retaining tab 22.

Figure 10:
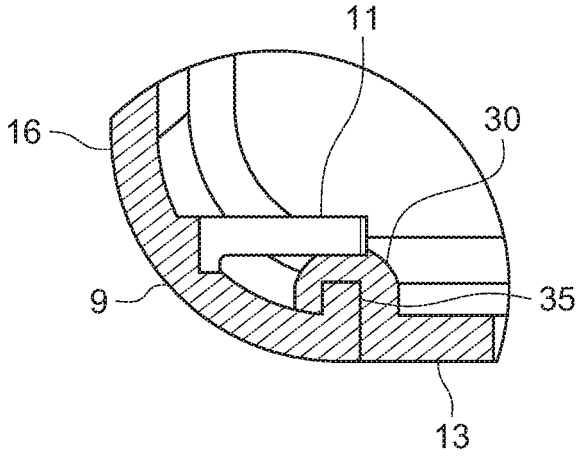
FIG. 10 is an expanded view of the interlocking guides shown in FIG. 9 according to a preferred embodiment.

The panels are detachably interconnected along the dimensions that abut one another. In a preferred embodiment, the front and rear panels have a female attachment member such as female guide 30, such as a U-shaped recess as seen in FIG. 10. The side panels have a male attachment member such as a male guide that includes a tab 35 extending outwardly from the panel member and a protruding retaining tab 11 as seen in FIG. 10 along curved edge 9.

The male guide 9 and female guide 30 engage each other in the manner shown in FIG. 10 such that the U-shaped recess 30 is sandwiched between tab 35 and retaining tab 11. For example, the front or rear panels can be lowered vertically into the male guide 9 of the side panels or vice versa. Likewise, the side panels 15 and 16 can include the female attachment member and the front and rear panels can include the male attachment member.

Figure 18:
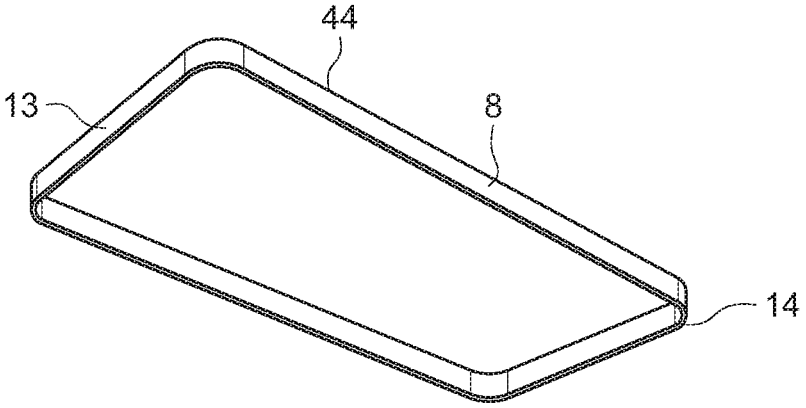
FIG. 18 shows a three-dimensional view of the lid portion when viewed from below according to a preferred embodiment.
Figure 19:
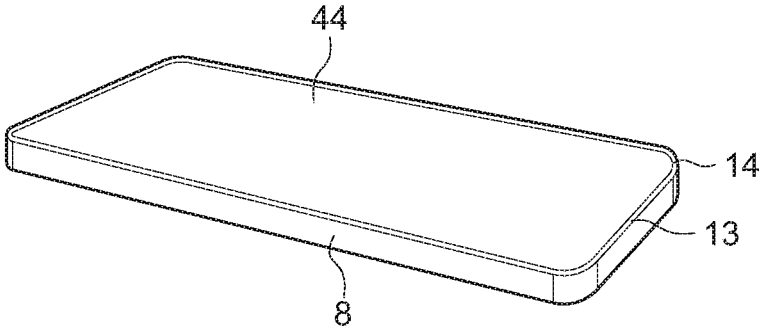
FIG. 19 shows a three-dimensional view of the lid portion when viewed from above according to a preferred embodiment.
Figure 20A:
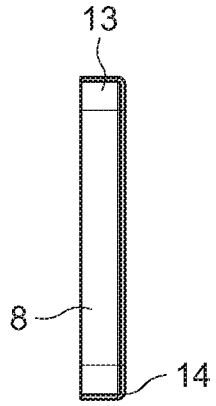
FIG. 20A shows a planar side view of the side of the lid according to a preferred embodiment.
Figure 20B:
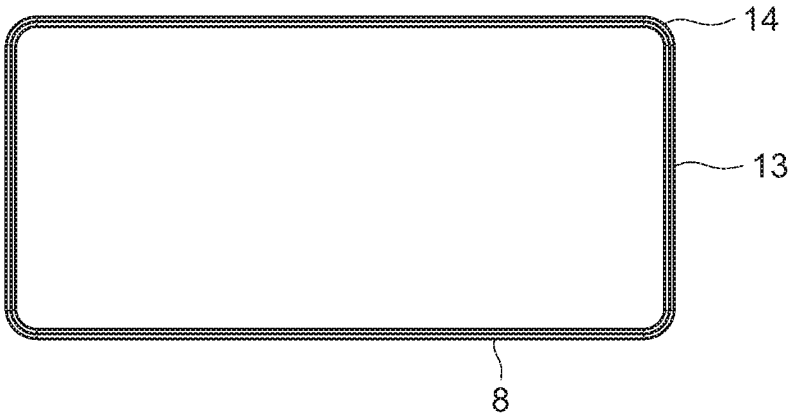
FIG. 20B shows a planar top view of the side of the lid looking inside according to a preferred embodiment.
Figure 20C:
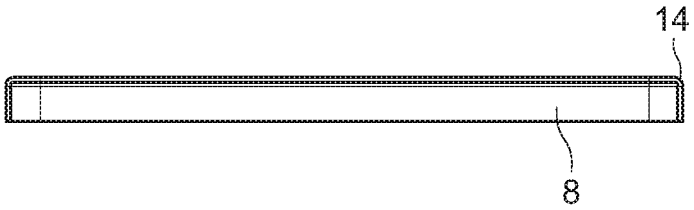
FIG. 20C shows a planar side view of the side of the lid according to a preferred embodiment.

The container also includes a lid 44 as seen in FIGS. 18, 19 preferably a one-piece, fluid or water-proof structure having a substantially quadrilateral cross-section with a perimeter edge 8 extending in a downward direction as seen in FIG. 18, which will overlay each of the side panels when the container is assembled as seen in FIG. 7B.

The container also includes a handle 26 as seen in FIGS. 21 and 22A-C. Handle is preferably a one-piece, fluid- or water-proof structure that is curved 19 as seen on FIG. 21 to allow for easy carrying of the base, protrusions 18 and retaining tabs 17 each being on an opposite side of the handle 18 as see in FIG. 21. When the handle 26 is used to carry the disassembled base, the protrusions 18 rest on the top of the vertical sides 7 and the tabs inserts into slot 41 of the base.

Figure 8:
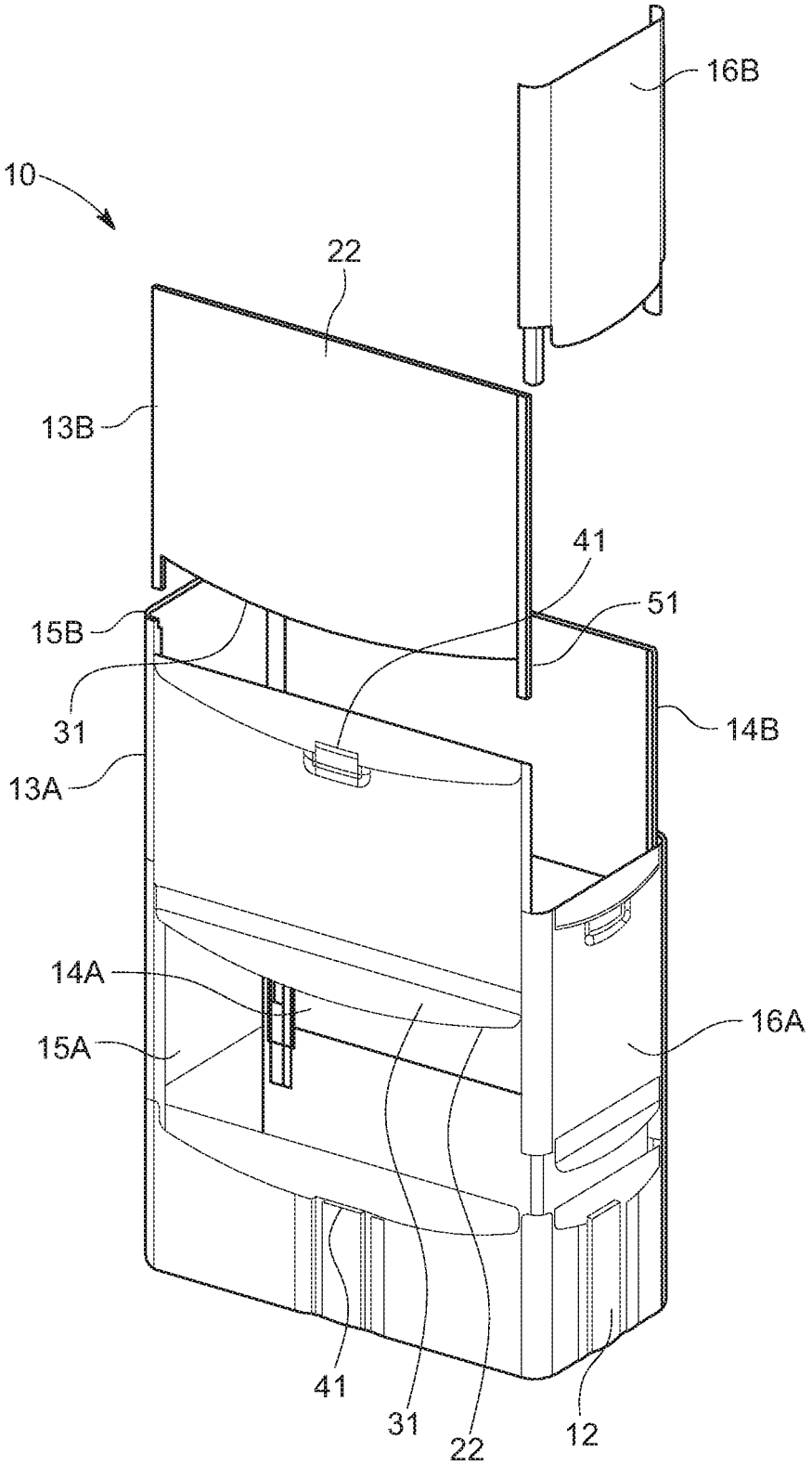
FIG. 8 depicts a partially exploded view of the preferred embodiment shown in FIG. 12.
Figure 9:
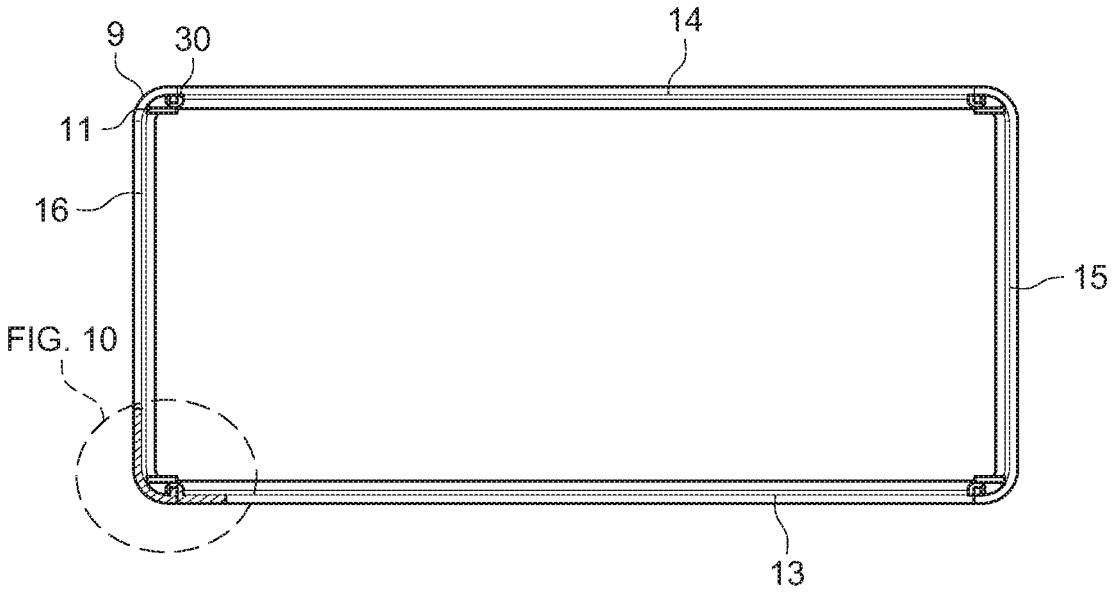
FIG. 9 depicts a top view of the waste container shown in FIG. 7A according to a preferred embodiment.

The bottom panels 13A,14A,15A,16A as seen in FIG. 8 rest securely attaching to the base member 12 as described above. The edges of the panels which engage one another can likewise be interconnected as described above.

Any of the top panels 13B,14B,15B,16B can be assembled first vertically to the bottom panels 13A,14A, 15A,16A. The top panels rest securely attaching to the bottom panels wall with the undercut 21 and slot 41 as seen in FIG. 8 locking into a retaining tab 22 as seen in FIG. 15. Although the retaining tab 22 is shown in FIG. 15 with respect to a single piece panel the same structure applies to a two-piece panel. The retaining tab 22 is attached to the top of each bottom panel under the over lip 31 as seen in FIG. 13. The over lip of each top panel rests securely on the bottom panels wall as seen in FIG. 8. Panel support bars 51 as seen in FIG. 8 extend from the top panels make the structure more secure when attached to the bottom panels 13A,14A,15A,16A. As seen from the figures and from above, the structure and method for attaching the top to the bottom panels can be the same or substantially the same as the structure and method to connect the panels (either the single- or two-piece) to the base member.

The lid 44 as seen in FIG. 19, is placed on the container by lowering the lid onto each of the panels whereby lip 8 engages the top dimension of the panels, allowing the lid to be closed and rest securely on each of the panels when assembled as seen in FIG. 7B. As noted above, the lid can also be hinged in a manner well known in the art.

Any of the top panels 13B,14B,15B,16B can be disengaged from bottom panels 13A, 14A, 15A, 16A by pulling retaining tab 22 away from the container and out of slot 41. The top panel is raised upwardly from the bottom panels wall to disengage support bars 51 and further slid upwardly and out such that female guide 30 is no longer sandwiched between tab 35 and retaining tab 11 seen in FIG. 10, thus releasing top panel from the bottom panel and releasing the panels from each other.

Any of the bottom panels 13A,14A,15A,16A can be disengaged from base member 12 by pulling retaining tab 22 away from the container and out of slot 41. The bottom panel is raised upwardly from the base member to disengage support bars 51 and further slid upwardly and out such that female guide 30 is no longer sandwiched between tab 35 and retaining tab 11 seen in FIG. 10, thus releasing the bottom panel from base member and releasing the panels from each other.

Figure 21:
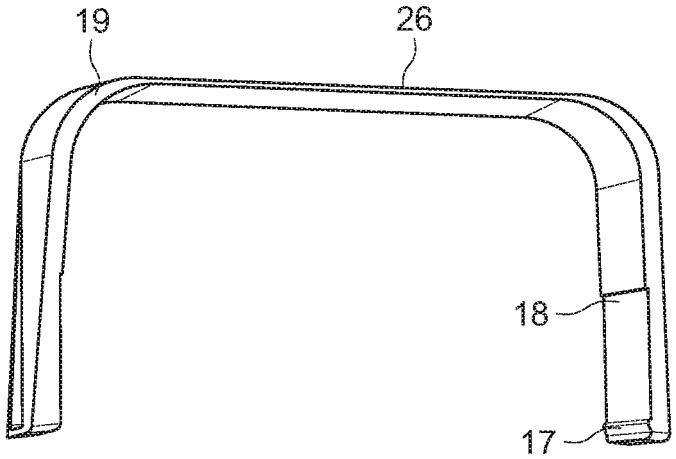
FIG. 21 shows a three-dimensional view of a handle removably attachable to the base portion according to a preferred embodiment.
Figure 22A:
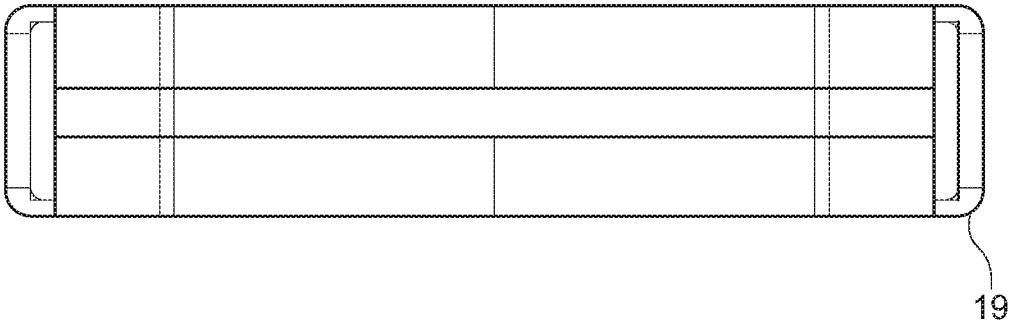
FIG. 22A shows a planar top view of the side of the handle according to a preferred embodiment.
Figure 22B:
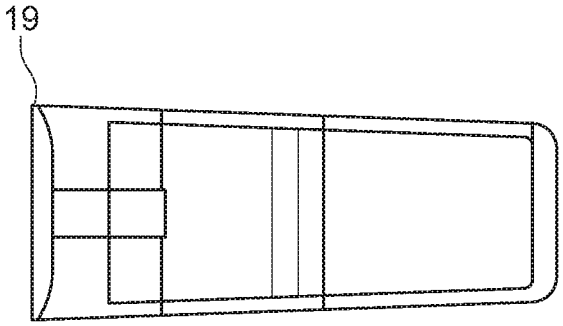
FIG. 22B shows a planar side view of the handle according to a preferred embodiment.
Figure 22C:
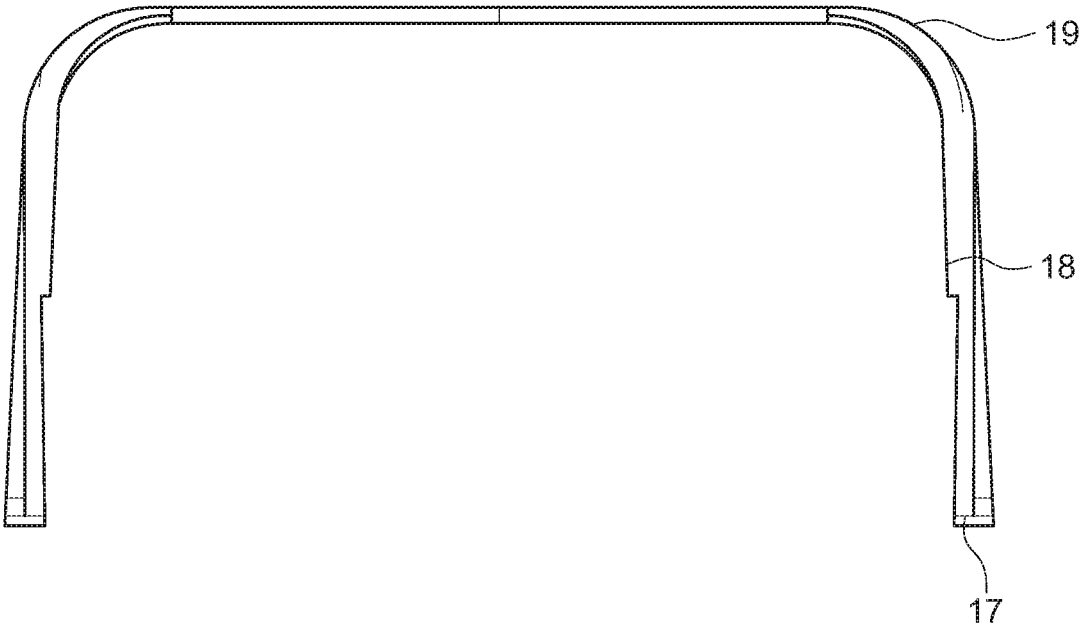
FIG. 22C shows a planar side view of the side of the handle according to a preferred embodiment.
Figure 23A:
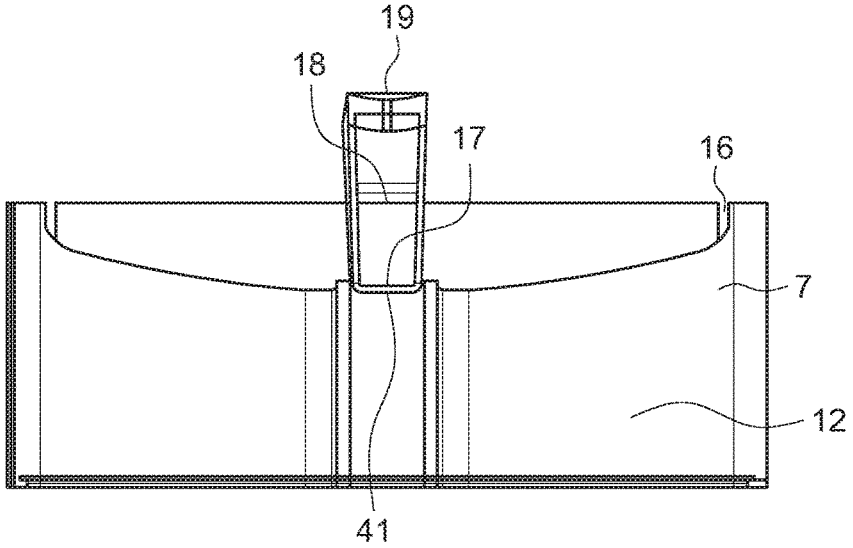
FIG. 23A shows a planar side view of the handle attached to the base portion according to a preferred embodiment.
Figure 23B:
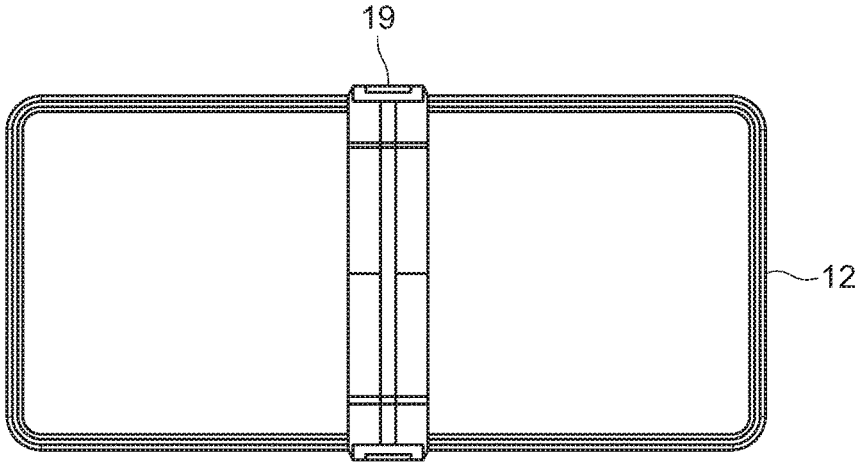
FIG. 23B shows a planar top view of the handle attached to the base portion according to a preferred embodiment.
Figure 23C:
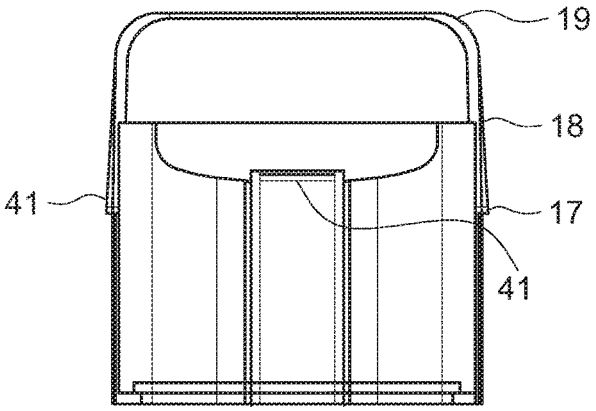
FIG. 23C shows a planar side view of the handle attached to the base portion according to a preferred embodiment.

In another embodiment, the handle 26 can be attached to the base member when base member 12 is separated from panels as seen in FIG. 23A-C. This is preferably accomplished by protrusions or ledges 18 extending from each end of handle as shown in FIG. 21 and tabs 17 on each end of the handle to interlock with opposite side walls of the base member 12 by resting protrusions 18 on the top surface of wall 7 and inserting tabs 17 into slots 41 to form a tight fit. This results in the base member 12 being able to hold liquids and can be used as a sanitation bucket or mop bucket.

The handle 26 is removed from the base member 12 by lifting outwardly the tab 17 of the handle 26 away from the base, thus, removing the handle 26 from the base member.

When all panels, and optionally the handle are disassembled from the base member all pieces of the can fit into a dish washer or sink for sanitation purposes to at least partially remove microbes in the waste container, thus making the concept proven better and more reliable in providing a higher level of cleanliness in living or working quarters.

The assembly of the trash container can be readily determined by techniques described above and known in the art. Additional exemplary methods are as follows.

Any of the panels 13, 14, 15, 16 as shown in FIG. 7A can be assembled first to the base member as shown in FIG. 14. The panels 13, 14, 15, 16 as seen in FIG. 7 rest securely attaching to the base member as shown in FIG. 14 with the undercut 21 and slot 41 as seen in FIG. 16 locking into a retaining tab 22 as seen in FIG. 15. The over lip 31 of each panel rests securely on the base wall as seen in FIG. 7A, preferably flush as described above. Panels support bars 51 as seen in FIG. 15 extending from the panels as seen in FIG. 15 and make the structure more fit when attached to the base wall. The base wall 7 as seen in FIG. 16 is protruded upward from the floor significantly to catch any liquid spills and keep them contained.

Figure 11:
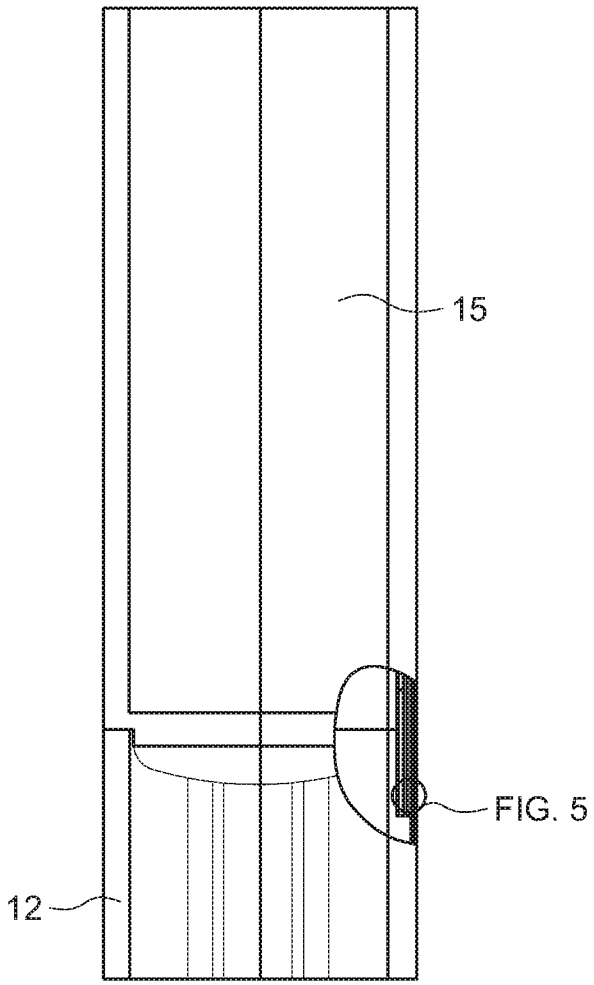
FIG. 11 shows a side view of the assembled waste container according to a preferred embodiment with a partial cutaway engaging retaining tab for secure fit.
Figure 11A:
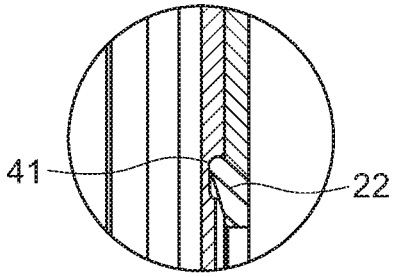
FIG. 11A shows an expanded view of the interlocking tab and recess shown in FIG. 11 according to a preferred embodiment having ends that curve in a direction of the side panels and having interlocking guides in the curved section according to a preferred embodiment.
Figure 12:
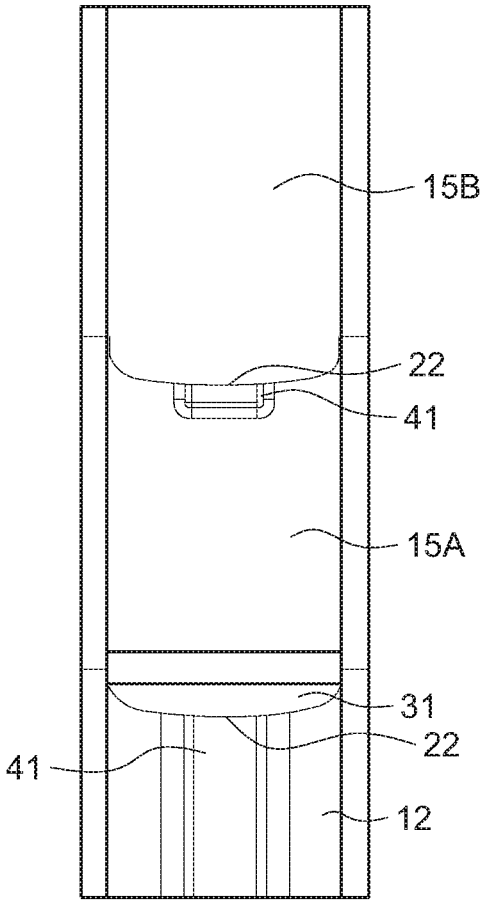
FIG. 12 shows a side view of the smaller or side dimension of assembled waste container according to a preferred embodiment.

The front and rear panel FIG. 13 have female guides 30 where the front or rear panel is lowered vertically into the male guide 9 as seen in FIG. 10 and in between the retaining tab 11 as also seen in FIG. 10. Thus, when the panels are lowered the support bars 51 fits to the bases front and rear clearance slots 16 as seen in FIG. 14, the over lip 3 of the panels resting on the base wall 7 along with the undercut of the base 21 and slot 41 as seen in the expanded view of FIG. 11A locking the retaining tab 22.

The side panels FIG. 15 have male guides 9 as seen in FIG. 10 which are lowered vertically into the female guide 30 as seen in FIG. 10 and in between the retaining tab 11.

Another aspect of the invention includes the waste container as described above in a disassembled state. Also included in the kit are optionally instructions for assembly, such as using the techniques described above; and instructions for loading disassembled pieces into an automatic dishwasher. When kit includes a handle, the instructions can also include instructions for attaching the handle to a base member and using the handle/base member assembly to carry liquids, such as detergent water to clean surfaces. Such as kit may be available wherever waste containers or cleaning supplies are sold.

Another aspect of the invention includes a method of cleaning the waste container as described above. The method includes disassembling the waste container; placing the disassembled waste container into an automatic dishwasher or sink; washing the container; and removing the container.

VI. Miscellaneous

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art.

For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A waste container comprising:

a substantially quadrilateral base member having a plurality of vertically extending walls and a plurality of perimeter edges, wherein the base member is water tight;

a plurality of panels extending substantially vertically from the base member comprising:

a front panel;

a rear panel, wherein the front panel and the rear panel are disposed opposite one another;

a first side panel;

a second side panel, wherein the first side panel and second side panel are disposed opposite one another, wherein each of the plurality of panels abut two other panels of the plurality of panels, and wherein the plurality of panels are detachably interconnected to one another;

a panel attachment member located along each of the perimeter edges of the base member;

a base attachment member located along an edge of each of the plurality of panels, wherein each base attachment member comprises a flap, wherein each flap is parallel to a respective vertically extending wall to which it is configured to attach, and wherein each flap includes a tab that extends toward the interior of the waste container, wherein each flap and respective tab is configured to attach to a respective one of the panel attachment members, thereby attaching the plurality of panels to the base member and forming the waste container, wherein each panel attachment member comprises a flap recess in a respective one of the plurality of vertically extending walls to receive a respective flap, and each flap recess includes an additional recess configured to receive a tab on a respective flap, and wherein the container is adapted to separate into a configuration in which the base member and the plurality of panels are all detached from one another.

2. The waste container as claimed in claim 1, wherein the detached base member and panels are dimensioned to fit into a dishwasher or a sink.

3. The waste container as claimed in claim 2, wherein the sink is a kitchen sink and has dimensions of 30-by-40 inches.

4. The waste container as claimed in claim 1, wherein the base attachment member further comprises a bar extending from each lower corner of a partial container formed by the plurality of panels, in an assembled state, and wherein the panel attachment members comprise respective slots to receive each of the bars extending from each lower corner of the partial container.

5. The waste container as claimed in claim 1, further comprising a removable lid with a lip around a perimeter of the lid which extends substantially perpendicular to the lid and engages the plurality of panels.

6. The waste container according to claim 1, further comprising a removable handle, wherein the handle is adapted to connect to two of the vertically extending walls that are opposite one another when the container is in an unassembled state.

7. The waste container according to claim 6, further comprising protrusions on ends of the handle and corresponding recesses on the opposing walls to receive the protrusions.

8. A waste container kit comprising:

(a) the waste container as claimed in claim 7 in a disassembled state;

(b) instructions for assembly;

(c) instructions for loading disassembled pieces into an automatic dishwasher; and (d) instructions for attaching the handle to the base member.

9. A waste container kit comprising:

(a) the waste container as claimed in claim 1 in a disassembled state; and (b) instructions for loading disassembled pieces into an automatic dishwasher.

10. A waste container kit as claimed in claim 9, further comprising instructions for assembling the waste container.

11. A method of cleaning a waste container comprising:

(a) providing the waste container as claimed in claim 1;

(b) disassembling the waste container;

(c) placing the disassembled waste container into an automatic dishwasher or sink;

(d) washing the container; and (e) removing the container.

12. A waste container comprising:

a substantially quadrilateral base member having a perimeter edge;

a plurality of panels extending substantially vertically from the quadrilateral base member comprising:

a front panel;

a rear panel, wherein the front and rear panel are disposed opposite one another;

a first side panel;

a second side panel, wherein the first side and second side panel are disposed opposite one another, wherein each of the plurality of panels abut two other panels of the plurality of panels, and wherein the plurality of panels are detachably interconnected to one another;

a panel attachment member located along each of the perimeter edges of the base member;

a base attachment member located along an edge of each of the plurality of panels, wherein the panels and base attachment members are adapted to interconnect;

wherein the container is adapted to separate into a configuration in which the base member and the plurality of panels are all detached from one another;

a plurality of mated attachment member sets each set including a male attachment member and a female attachment member wherein each substantially vertical dimension of the plurality of panels includes a male attachment member or a female attachment of one of the plurality of mated attachment member sets, wherein one of the plurality of panels has the male attachment member of one of the plurality of mated attachment member sets and another of the plurality of panels that abuts the one of the plurality of panels has a female attachment member of said one of the plurality of mated attachment member sets, wherein each male attachment member further comprises a tab extending outwardly from a respective one of the plurality of panels and each female attachment member comprises a U-shaped recess having arms extending from a respective one of the plurality of panels, wherein in an assembled state each tab is disposed inside the arms of a respective one of the U-shaped recess, and wherein each male attachment member further comprises a retaining tab extending outwardly from a respective panel member in a direction substantially perpendicular to the respective tab of the male attachment member, wherein in an assembled state the bottom of each U-shaped recess is sandwiched between a respective tab and respective retaining tab of a male attachment member.

13. The waste container as claimed in claim 12, wherein at least one of the plurality of panels has at least one edge that curves in a direction of an adjacent other one of the plurality of panels in an assembled state of the waste container.

14. The waste container as claimed in claim 13, wherein the at least one edge that curves has the tab and retaining tab extending therefrom, of a respective one of the male attachment members, and the adjacent other one of the plurality of panels has an edge that abuts the at least one edge that curves and has the U-shaped recess, of a respective one of the female attachment members, that receives the tab.

* * * * *